US008741213B2

(12) United States Patent
Hugens, Jr. et al.

(10) Patent No.: US 8,741,213 B2
(45) Date of Patent: Jun. 3, 2014

(54) METHOD AND APPARATUS FOR MELTING METAL

(75) Inventors: John R. Hugens, Jr., Suwanee, GA (US); Mike Gorczewski, Ajax (CA); Ronald Ian Carmichael, Pickering (CA)

(73) Assignee: Fives North American Combustion, Inc., Cleveland, OH (US)

( * ) Notice: Subject to any disclaimer, the term of this patent is extended or adjusted under 35 U.S.C. 154(b) by 0 days.

(21) Appl. No.: 13/405,461

(22) Filed: Feb. 27, 2012

(65) Prior Publication Data

US 2012/0146268 A1 Jun. 14, 2012

Related U.S. Application Data

(62) Division of application No. 12/139,534, filed on Jun. 16, 2008, now Pat. No. 8,153,049.

(51) Int. Cl.
*F27B 3/18* (2006.01)

(52) U.S. Cl.
USPC ..... 266/236; 266/44; 266/242

(58) Field of Classification Search
USPC ..... 266/242, 900, 901, 44, 200, 236; 432/158, 156, 11, 138, 185
See application file for complete search history.

(56) References Cited

U.S. PATENT DOCUMENTS

| | | | | | |
|---|---|---|---|---|---|
| 2,298,055 | A | * | 10/1942 | Hulme et al. | 75/638 |
| 3,211,546 | A | * | 10/1965 | Kozma, Jr. | 75/686 |
| 3,809,378 | A | * | 5/1974 | Iida | 266/214 |
| 4,353,532 | A | * | 10/1982 | Jay | 266/242 |
| 4,581,063 | A | * | 4/1986 | Oyabu et al. | 75/686 |
| 5,078,368 | A | * | 1/1992 | Hemsath | 266/236 |

* cited by examiner

*Primary Examiner* — Scott Kastler
*Assistant Examiner* — Michael Aboagye
(74) *Attorney, Agent, or Firm* — Thompson Hine LLP

(57) ABSTRACT

A stack of copper plates is placed in a melting chamber having a closed roof of refractory material. The stack is placed in a tilted orientation leaning against a side wall of the melting chamber, with lower edges of the copper plates resting on an inclined hearth surface. A door to the melting chamber is closed to block the infiltration of oxygen. A burner is fired into the melting chamber to heat the closed roof of refractory material, and the stack of copper plates is melted under the influence of combustion products from the burner and heat radiated from the closed roof. Molten copper is drained downward from the bottom edge of the inclined hearth surface to avoid immersing the copper plates in a molten bath.

4 Claims, 4 Drawing Sheets

METHOD AND APPARATUS FOR MELTING METAL

RELATED APPLICATIONS

This application is a division of U.S. patent application Ser. No. 12/139,534, filed Jun. 16, 2008 now U.S. Pat. No. 8,153,049.

TECHNICAL FIELD

This technology relates to furnaces for melting metal.

BACKGROUND

Metal for a casting process is melted in a furnace. The furnace has a melting chamber with a hearth formed of refractory material. A load of metal pieces is placed on the hearth, and burners are fired into the melting chamber to melt the load of metal pieces on the hearth. Molten metal then flows from the melting chamber to a reservoir that feeds the casting process.

SUMMARY

In the method, a copper plate is placed in a melting chamber having a closed roof of refractory material. The plate is placed in a tilted orientation leaning against a side wall of the melting chamber, with a lower edge of the plate resting on an inclined hearth surface. A door to the melting chamber is closed to block the infiltration of oxygen into the melting chamber. A burner is fired into the melting chamber to heat the closed roof of refractory material, and the plate is melted under the influence of combustion products from the burner and heat radiated from the closed roof. Molten copper is drained downward from the bottom edge of the inclined hearth surface to avoid immersing the plate in a molten bath.

The apparatus includes a refractory structure defining a melting chamber with a closed roof, side walls including a side wall with a flue, and an inclined hearth surface. The bottom edge of the inclined hearth surface is level with the bottom of the melting chamber. A port is configured to drain molten metal downward from the bottom edge of the inclined hearth surface so that a load of metal pieces can be melted on the inclined hearth surface without being immersed in a molten bath.

Summarized differently, the apparatus includes a refractory structure defining a melting chamber with an inclined hearth surface, a charge opening, and a shelf that is located between the charge opening and the inclined hearth surface. The shelf is configured to hold metal pieces in readiness for movement from the shelf onto the inclined hearth surface. An inner edge of the shelf is located in a position for metal pieces to fall from the shelf to the inclined hearth surface upon being moved past the inner edge.

DETAILED DESCRIPTION

The drawings show an apparatus 10 for melting copper plates 12. This apparatus 10 has parts that are examples of the elements recited in the claims. The following description thus includes examples of how a person of ordinary skill in the art can make and use the claimed invention. It is presented here to meet the statutory requirements of written description, enablement, and best mode without imposing limitations that are not recited in the claims.

Figure 1:
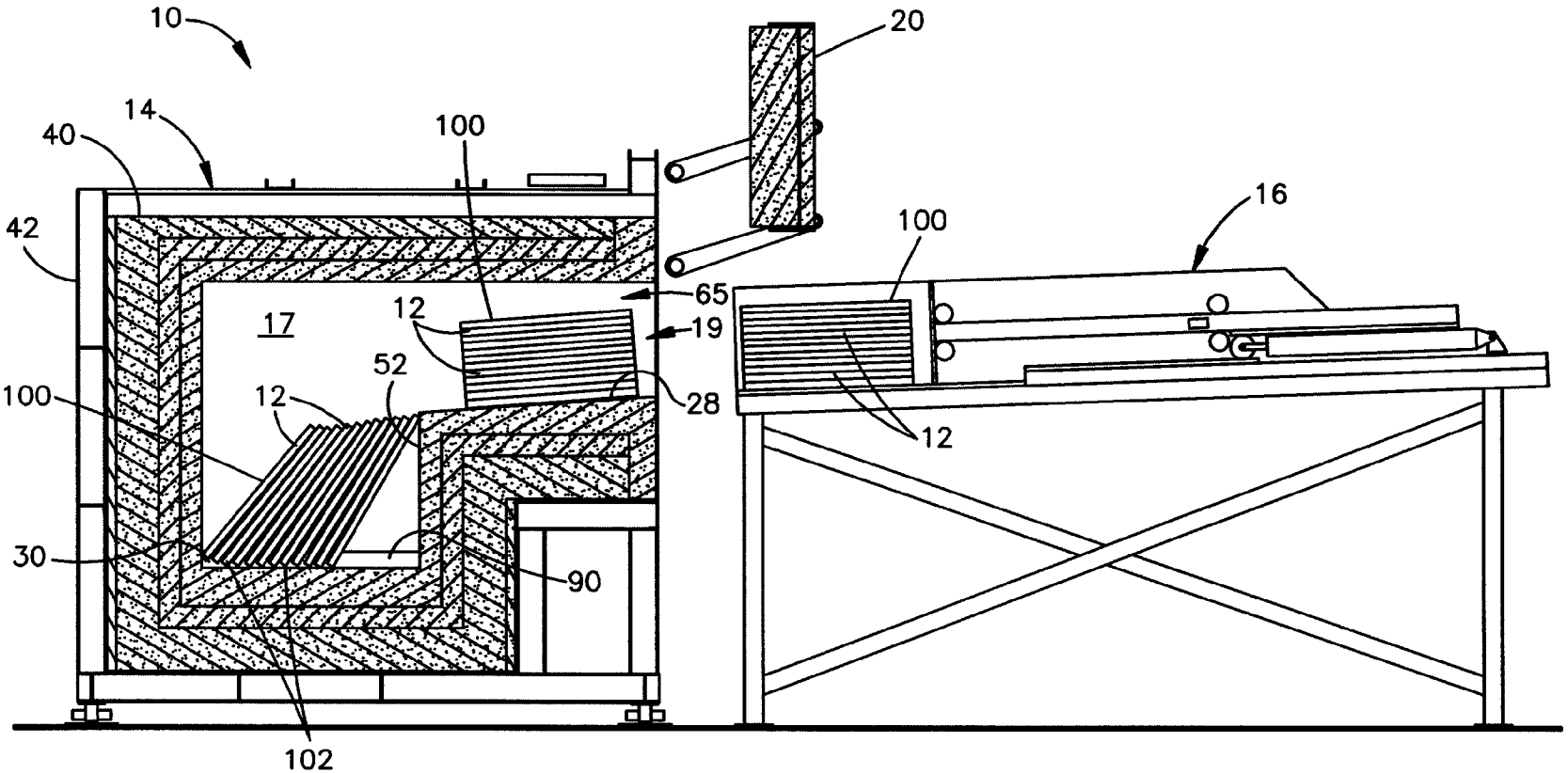
FIG. 1 is a schematic view of an apparatus for melting metal, including a furnace and a device for loading metal into the furnace.

As shown schematically in FIG. 1, the apparatus 10 includes a melting furnace 14 and a loading device 16. The furnace 14 has a melting chamber 17 with a charge opening 19 and a door 20. In operation, the door 20 is opened and closed to allow the loading device 16 to insert copper plates 12 through the charge opening 19. As newly inserted plates 12 are moved through the charge opening 19, they push previously inserted plates 12 to fall from a shelf 28 onto a hearth 30 at the bottom of the melting chamber 17. The door 20 is then closed, and the plates 12 on the shelf 28 are preheated as the plates 12 on the hearth 30 are melted.

Figure 2:
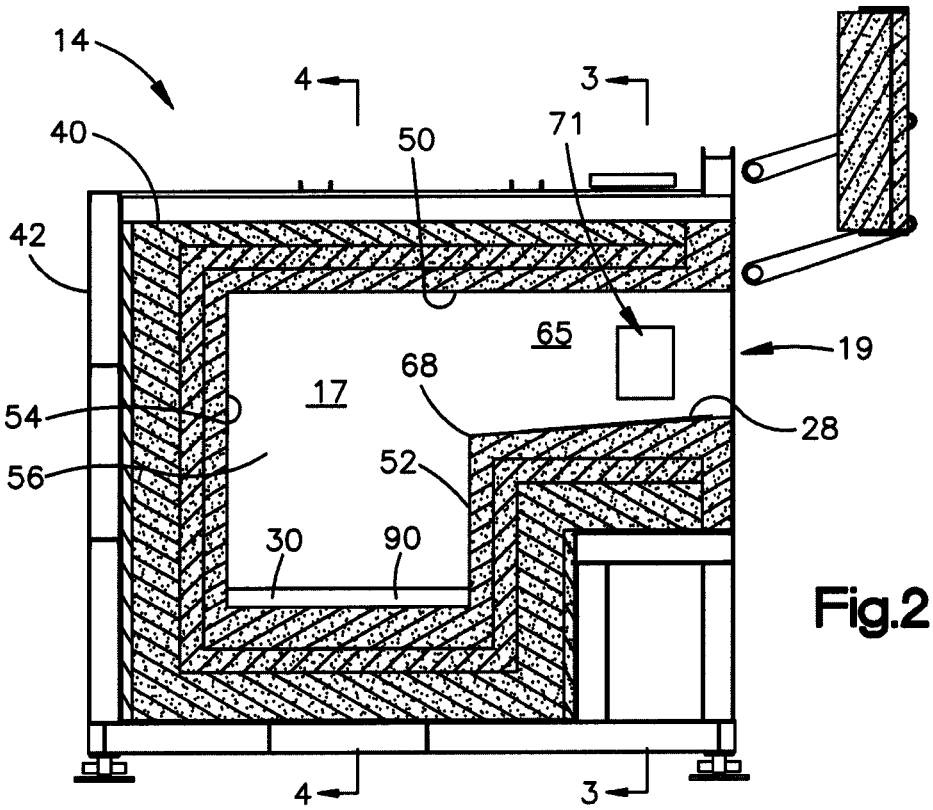
FIG. 2 is an enlarged view of the furnace shown in FIG. 1.
Figure 3:
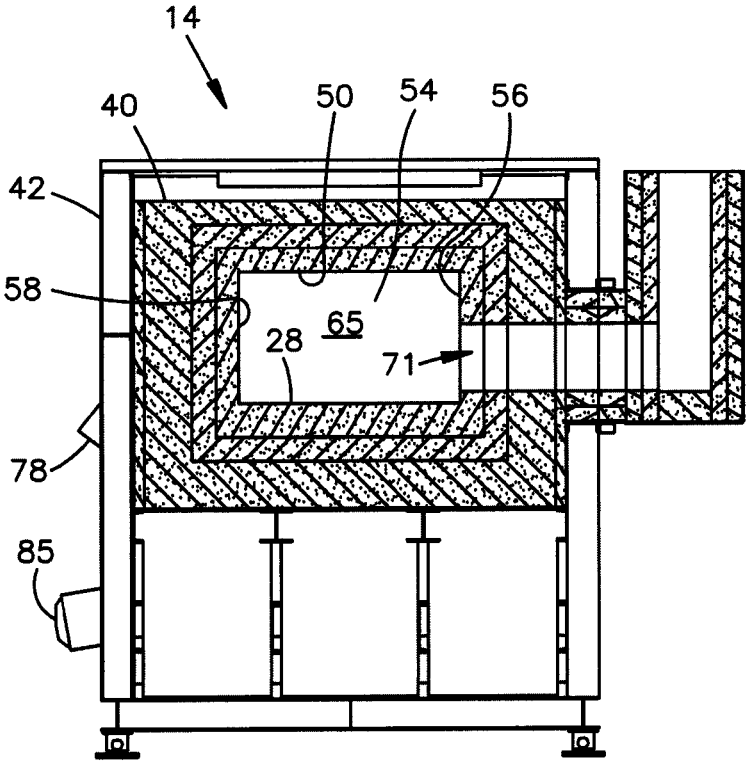
FIG. 3 is a sectional view taken on line 3-3 of FIG. 2.
Figure 4:
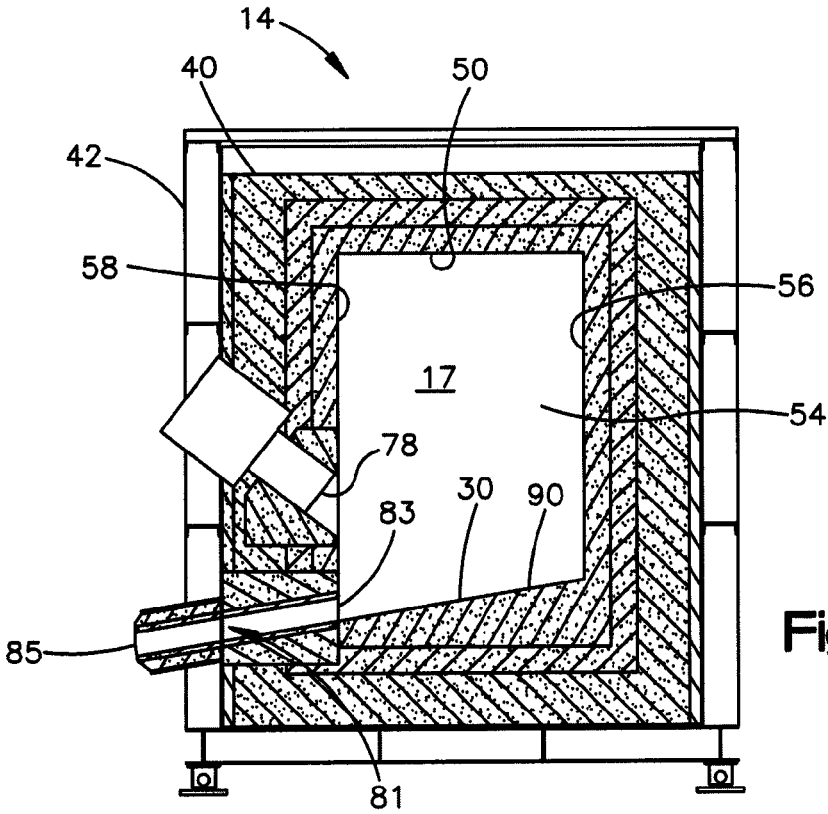
FIG. 4 is a sectional view taken on line 4-4 of FIG. 3.

As shown separately in FIGS. 2-4, the furnace 14 includes a refractory structure 40 with a metal frame 42. The refractory structure 40 forms the hearth 30 at the bottom of the melting chamber 17. The refractory structure 40 also provides the melting chamber 17 with a closed roof 50 and four vertical side walls. These include a front side wall 52, a rear side wall 54, and left and right side walls 56 and 58. The refractory structure 40 further defines a preheating chamber 65 in which the shelf 28 is located. The shelf 28 is inclined downward from the charge opening 19, and has an inner edge 68 (FIG. 2) at the top of the front side wall 52 of the melting chamber 17.

One side wall 56 of the melting chamber 17 has a flue 71 (FIGS. 2 and 4). Another side wall 58 supports a burner 78 (FIG. 4) that is oriented to fire into the melting chamber 17 in a direction extending downward across the hearth 30. A molten metal drainage passage 81 extends through that side wall 58. The passage 81 has an inlet port 83 beside the hearth 30, and has an outlet port 85 at the exterior of the refractory structure 40.

Figure 5:
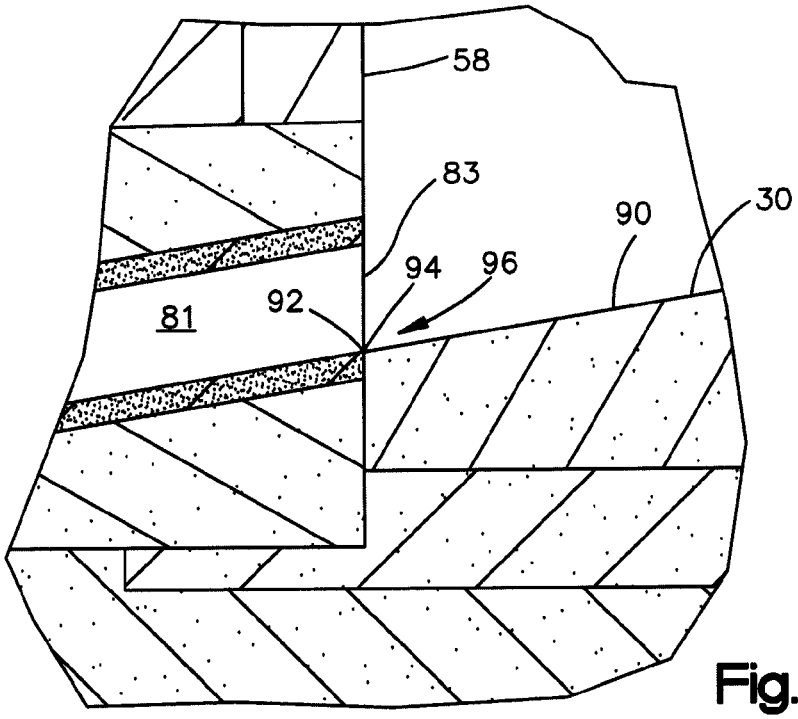
FIG. 5 is an enlarged detailed view of parts shown in FIG. 4.

As best shown in enlarged detail in FIG. 5, the hearth 30 has an inclined surface 90 with a bottom edge 92. The inclined surface 90 intersects the adjacent side wall 58 at the bottom edge 94 of that side wall 58 so that the melting chamber 17 has a bottom corner 96 at the adjoining bottom edges 92 and 94. The port 83 into the drainage passage 81 is located at the bottom corner 96, and is thus located to drain molten metal downward from the bottom edge 94 of the inclined hearth surface 90.

The copper plates 12 may be melted one at a time, but are preferably handled in stacks 100. Each plate 12 in a stack 100 is preferably square with sides of about 36 inches and a thickness of about 0.25 to 0.75 inches, and each stack 100 preferably includes 20 to 30 plates. In the example illustrated in FIG. 1, each stack 100 is placed on the shelf 28 in an upright condition in which a lowermost plate 12 overlies the shelf 28 beneath all other plates 12 in the stack 100, although the action of the loading device 16 may cause some horizontal shifting of plates 12 within the stack 100. When a newly inserted stack 100 is moved inward against a preheated stack 100 on the shelf 28, it pushes the preheated stack 100 to slide down the shelf 28 and past the inner edge 68 to fall from the shelf 28 to the hearth 30. The preheated copper plates 12 land on the hearth 30 as a tilted stack that leans against the front side wall 52, with lower edges 102 of the plates 12 resting on the inclined hearth surface 90. This may cause the plates 12 to fan out from each other across the hearth 30, and thereby to provide spaces in which combustion products from the burner 78 may flow between the plates 12 to promote melting. Melting is further promoted by heat radiated from the closed roof 50. The outlet port 85 preferably directs the molten copper into a reservoir from which it can be withdrawn for casting. Importantly, the furnace 14 avoids undesirable oxidation of the copper because the closed door 20 blocks the infiltration of oxygen into the melting chamber 17, and also because the molten copper is drained downward from the bottom edge 94 of the inclined hearth surface 90 to avoid the formation of a molten bath that could absorb oxygen from the atmosphere in the melting chamber 17.

Figure 6:
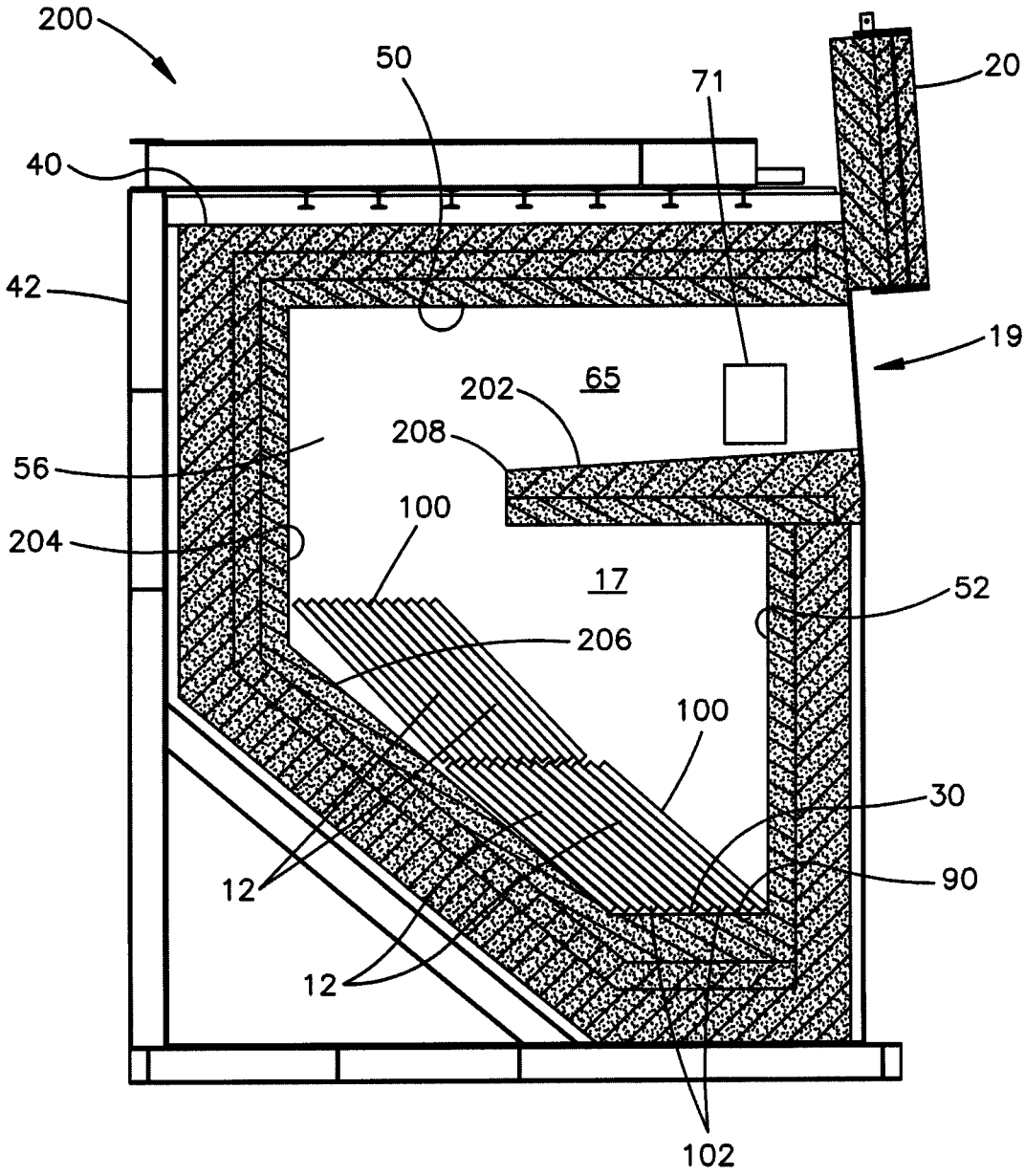
FIG. 6 is a schematic sectional view of another furnace for melting metal.

FIG. 6 shows another example of a furnace configured according to the claimed invention. This furnace 200 has many parts that are substantially the same as corresponding parts of the furnace 14 shown in FIGS. 1-6, as indicated by the use of the same reference numbers for such parts in FIGS. 7 and 1-6. However, the furnace 200 has a shelf 202 and a rear side wall 204 that differ from their counterparts 28 and 54 in the furnace 14. The shelf 202 projects inward from the front side wall 52 above the hearth 30 to project at least partially across the inclined hearth surface 90, and preferably to project fully across and beyond the inclined hearth surface 90 as shown in the drawing. A lower section 206 of the rear side wall 204 is inclined rather than vertical, and descends to the inclined hearth surface 90 at a greater angle of inclination. Additionally, the inclined wall section 206 reaches forward past the inner edge 208 of the shelf 202 to reach beneath the shelf 202. This configuration of the shelf 202 and the wall 204 causes a stack 100 of copper plates 12 that falls from the shelf 202 to land on a stack 100 that has previously fallen from the shelf 202, and then to slide downward along the inclined wall section 206 as the stack 100 on the hearth 30 melts downward beneath it. This enables each stack 100 to be further preheated before it reaches the hearth 30.

The patentable scope of the invention is defined by the claims, and may include other examples of how the invention can be made and used. Such other examples, which may be available either before or after the application filing date, are intended to be within the scope of the claims if they have elements that do not differ from the literal language of the claims, or if they have equivalent elements with insubstantial differences from the literal language of the claims.

The invention claimed is:

1. An apparatus comprising:

a refractory structure defining a melting chamber with a closed roof, side walls including a side wall with a flue, and an inclined hearth surface;

wherein the refractory structure further defines a charge opening and a shelf that is located between the charge opening and the inclined hearth surface, the shelf is configured to hold metal pieces in readiness for movement from the shelf onto the inclined hearth surface, and the shelf has an inner edge that is located above the inclined hearth surface in a position for metal pieces to fall from the shelf onto the inclined hearth surface upon being moved past the inner edge; and wherein the shelf projects from a side wall above the inclined hearth surface to project at least partially across the inclined hearth surface.

2. An apparatus as defined in claim 1 wherein the shelf projects from a side wall above the inclined hearth surface to project fully across the inclined hearth surface.

3. An apparatus as defined in claim 1 wherein the shelf projects from a side wall above the inclined hearth surface to project fully across and beyond the inclined hearth surface.

4. An apparatus as defined in claim 1 wherein the inclined hearth surface has a first angle of inclination, the side walls include an inclined side wall that descends to the inclined hearth surface with a second, greater angle of inclination, and the inclined side wall reaches beneath the inner edge of the shelf.

* * * * *